United States Patent [19]

Leibetseder et al.

[11] Patent Number: 4,805,379

[45] Date of Patent: Feb. 21, 1989

[54] PROCESS AND APPARATUS FOR PACKAGING STACKS WHICH CONSIST OF NESTED CUPLIKE OBJECTS AND HAVE THE BASIC SHAPE OF ELONGATE CYLINDERS

[76] Inventors: Ferdinand Leibetseder, Pestalozzistrasse 7, A-4300 St. Valentin; Kurt Böttcher, Liebermannweg 38, A-4020 Linz, both of Austria

[21] Appl. No.: 105,272

[22] Filed: Oct. 6, 1987

[51] Int. Cl.[4] ..... B65B 5/10

[52] U.S. Cl. ..... 53/444; 53/245; 53/260; 53/475; 53/536

[58] Field of Search ..... 53/475, 444, 443, 447, 53/536, 538, 537, 260, 245, 244

[56] References Cited

U.S. PATENT DOCUMENTS

| | | | |
|---|---|---|---|
| 2,767,536 | 10/1956 | Forkel | 53/245 X |
| 3,864,893 | 2/1975 | Murao | 53/536 X |
| 4,250,690 | 2/1981 | Lorenzen et al. | 53/536 X |
| 4,344,523 | 8/1982 | May et al. | 53/537 X |
| 4,686,816 | 8/1987 | Keller | 53/536 |

*Primary Examiner*—James F. Coan
*Attorney, Agent, or Firm*—Kurt Kelman

[57] ABSTRACT

Stacks which consist of nested cuplike objects and have the basic shape of elongate cylinders are inserted in the form of a plurality of layers consisting each of a plurality of stacks into containers. The stacks are first moved in their longitudinal direction as they are fed to the container above the same and are subsequently transversely pushed in a juxtaposed condition into layer-forming means, which are mounted over the container, until the layer-forming means contain a complete layer consisting of the stacks. Thereafter the layer-forming means together with the layer of stacks are lowered from above as far as the bottom or as far as to a previously formed layer. The bottom of the layer-forming means is then pulled out under the layer and is deflected and pulled up so that the layer is deposited in the container while the mutual orientation of the stacks is maintained. The layer-forming means are subsequently raised into the region in which the individual stacks are fed, the bottom is moved to its closed position, and a new layer is formed by a feeding of individual stacks.

9 Claims, 3 Drawing Sheets

PROCESS AND APPARATUS FOR PACKAGING STACKS WHICH CONSIST OF NESTED CUPLIKE OBJECTS AND HAVE THE BASIC SHAPE OF ELONGATE CYLINDERS

BACKGROUND OF THE INVENTION

1. Field of the Invention

This invention relates to a process of packaging stacks which consist of nested cuplike objects and have the basic shape of elongate cylinders, wherein said stacks are inserted into containers to form a plurality of layers consisting each of a plurality of stacks in a horizontal attitude, and to an apparatus which is suitable for carrying out the process.

2. Description of the Prior Art

In the packaging of units which have the basic shape of elongate cylinders and must be packaged in a horizontal attitude if they cannot stand with adequate stability on their end and if they are not adequately held together in the stack to permit their manipulation by suction lifters engaging the top end of the upright stack, it is known to place such stacks by hand into containers, such as boxes, or to throw them consecutively into open-topped containers via rolling-contact chutes or transverse conveyors. In that case the bottom layer will be orderly arranged although delicate elements may be damaged or the elements of the stacks may be somewhat pulled apart so that the stacks will no longer fit between the end walls of the box. Those units which constitute the next layer will be staggered as they fall into recesses existing between adjacent units of the bottom layer. If the width of the bottom layer is an integral multiple of the diameter of the stack, free spaces will be left in the second layer on the left and right so that only the odd-numbered layers will be completely filled and the number of units in the even-numbered layers will be smaller by one. It is known to provide carton boards between the several layers so that all layers will be uniformly filled but this will complicate the packaging operation. A manual packaging is often undesired from the aspect of hygiene if the stacks consist of cups, culture disks etc. made of paper or plastic and intended for medical purposes or for a packaging of foodstuffs, such as dairy products, e.g., yoghurt, milk beverages, cream etc. . The assembling to form the stacks or endless rods may be performed on the manufacturing machine without manual action. It is desired to permit also a packaging of the stacks without a manual action. If sacklike lining wrappers made of plastic film are used for the boxes and are sealed when the boxes have been filled, a manual packaging was previously required so that there was a risk of contamination.

A fully automatic packaging in boxes which are not provided with sacklike lining wrappers can be performed by means of a known packaging machine in which a lifting deck is disposed at the end of a feed track on which individual stacks are moved and optionally roll in a transverse orientation. A box is so attached to the lifting table that the opening of the box faces the feed track, i.e., in a lateral direction. By means of a feed conveyor the stacks are successively pushed into the box from the side. When a layer has been filled, the box is lowered by the lifting deck to the extent of the height of one layer so that the next layer can be formed on said layer and on the box side wall which lies on the deck. The pushing-in is difficult because the stacks may fall into the recesses of the preceding layer. It is also difficult to properly align the individual stacks. When the box has been filled it must be tilted through 90° to rest on its bottom. Separate means must be provided to prevent the stacks from being shifted and from falling out of the box during the tilting operation.

SUMMARY OF THE INVENTION

It is an object of the invention to provide a process of packaging elongate cylindrical stacks which consist of nested cuplike objects, which process permits an automatic orderly packaging of the stacks in a plurality of layers consisting each of a plurality of stacks in such a manner that successive layers may contain equal numbers of and the stacks are handled gently during the packaging operation.

It is another object of the invention to provide a process by which nested objects fed in the form of an endless string are caused before the packaging operation to form stacks which are equal in length or in number of object and which are subsequently packaged.

Another object of the invention is to provide a process which permits an automatic packaging of the stacks and to provide sacklike wrappers, which are attached in the container and can be airtightly closed when the container has been filled.

It is a further object of the invention to provide a simple apparatus which is reliable in operation and can be used to carry out the process and to effect an automatic packing of stacks having the basic shape of elongate cylinders.

The main object of the invention is accomplished with a process in which the stacks in a horizontal attitude are fed in their longitudinal direction to the container above the latter and are then pushed transversely to their longitudinal direction to layer-forming means, which are arranged over the container, until the layer-forming means contain a complete layer of stacks, whereafter the layer-forming means and the layer of stacks are lowered into the container from above until the layer-forming means have reached the bottom of the container or a layer that has previously been formed in the container, and the bottom of the layer-forming means is then deflected and is pulled out under the layer and upwardly beside the layer so that the layer is deposited in the container while the mutual orientation of the stacks in the layer is maintained, and thereafter the layer-forming means are raised into the region in which the individual stacks are fed, the flexible bottom is returned to its closed position and a new layer is formed by a feeding of individual stacks.

If the cuplike objedts are fed in the form of an endless rod, the individual objects can be counted as they are advanced and when objects in the number intended for a stack have been counted the stack can be pulled from the rod and fed to the packaging operation.

A flexible sacklike wrapper may be inserted into the container and with the aid of platelike elements which extend into the container in front of the ends of the stack and have been introduced before the deposition of the first layer said wrapper is held in the form of an open-topped liner, which substantially contacts the bottom and side walls of the usually parallelepipedic container and protrudes above the side walls, and when the last layer has been inserted the platelike elements are upwardly pulled out of the container and the wrapper is closed. The wrapper may be evacuated and may subsequently be airtightly closed so that the wrapper will constitute a package which can even be removed from the container and will hold the packaged stacks in the proper position and has an external shape that is determined by the container.

An apparatus for carrying out t at process comprises a filling station for supporting the containers, which by means of a conveyor are movable into and out of the filling station, a feeder for feeding stacks in a horizontal attitude in their longitudinal direction into a region that is disposed above the top edge of the containers, layer-forming means, which are disposed above the filling station and accommodate a layer formed by a plurality of juxtaposed stacks, a transverse conveyor, which is associated with the feeder, and means for adjusting the layer forming means so that the layer-forming means and a layer formed by the stacks can be lowered into the container to a preselectable depth, wherein the layer-forming means comprise a flexible bottom, which from a position in which the bottom closes the layer-forming means in the container can be deflected and pulled out toward one side and upwardly to expose a bottom opening of the layer-forming means, and control means are provided, which control the means for driving the transverse conveyor, the means for lifting and lowering the layer-forming means, and the inward and outward movement of the bottom of the layer-forming means.

BRIEF DESCRIPTION OF THE DRAWINGS

In FIG. 1, all parts of the layer-forming means and of the conveyor for the containers are shown in section.

Figure 2:
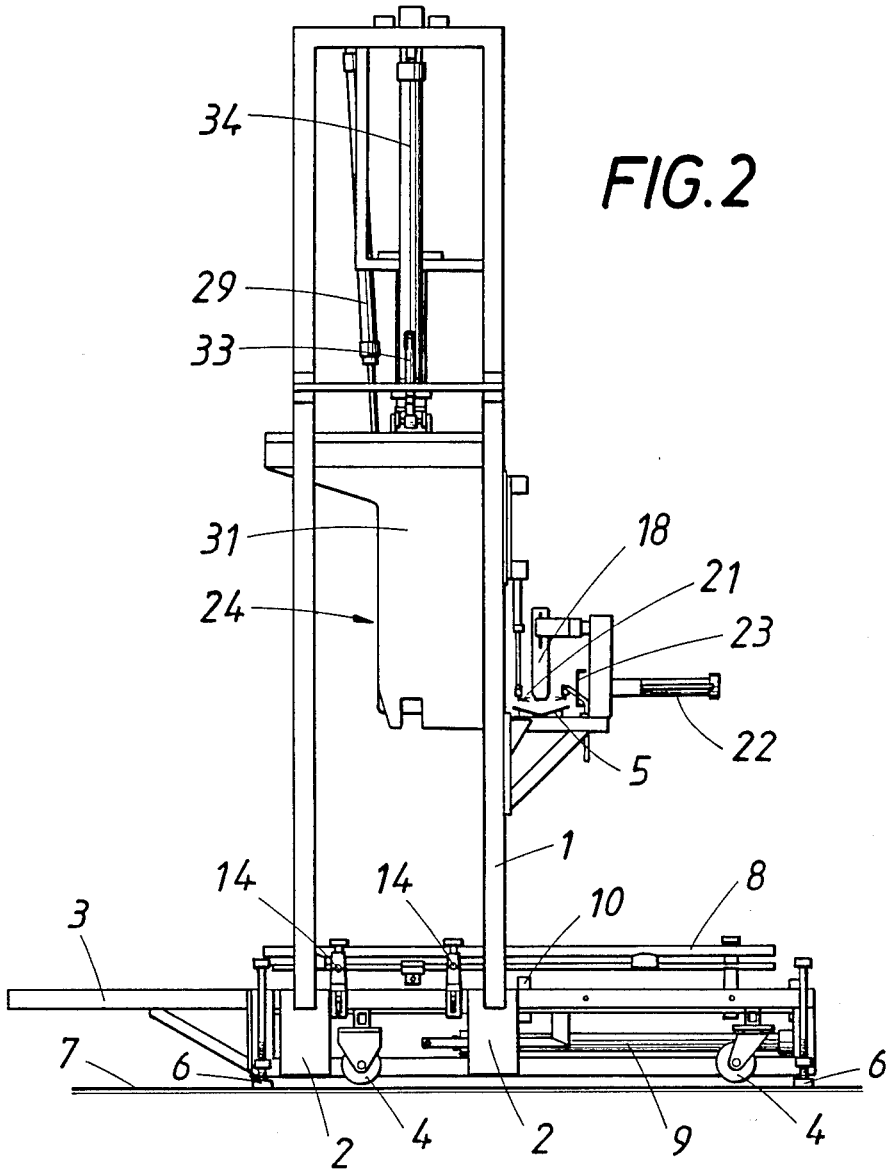
FIG. 2 is a diagrammatic side elevation associated with FIG. 1.
Figure 3:
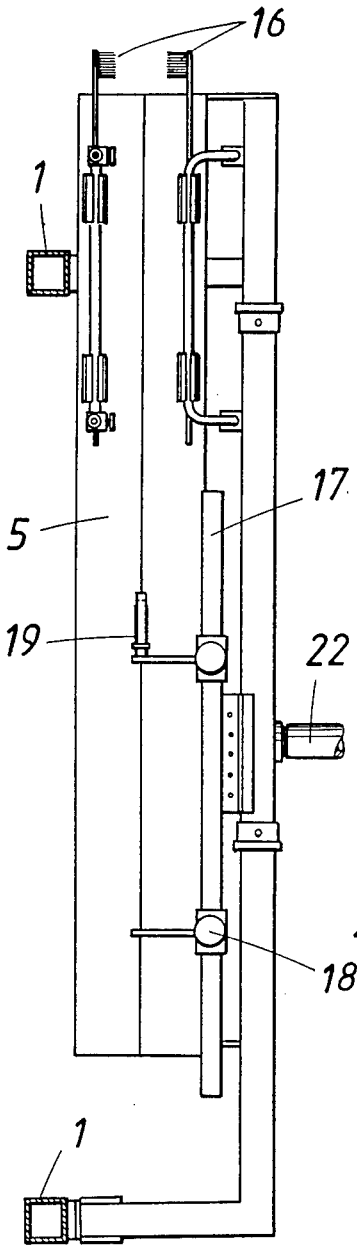
FIG. 3 is a partly sectional top plan view showing the steck feeder.

The apparatus comprises a mainframe 1 consisting of four interconnected columns and an underframe 2, which comprises a working deck 3. As is apparent from FIG. 2 the working deck 3 protrudes from the mainframe 1 on the left and right. Casters 4 permit the entire apparatus to be moved, e.g., when the apparatus is to be associated with a machine for man facturing cups or dishes of paper or plastic. In that case a feed trough 5 is connected to delivery means of said manufacturing machine so that nested cups or dishes in the form of a string are pushed out onto the trough in a horizontal attitude.

Figure 1:
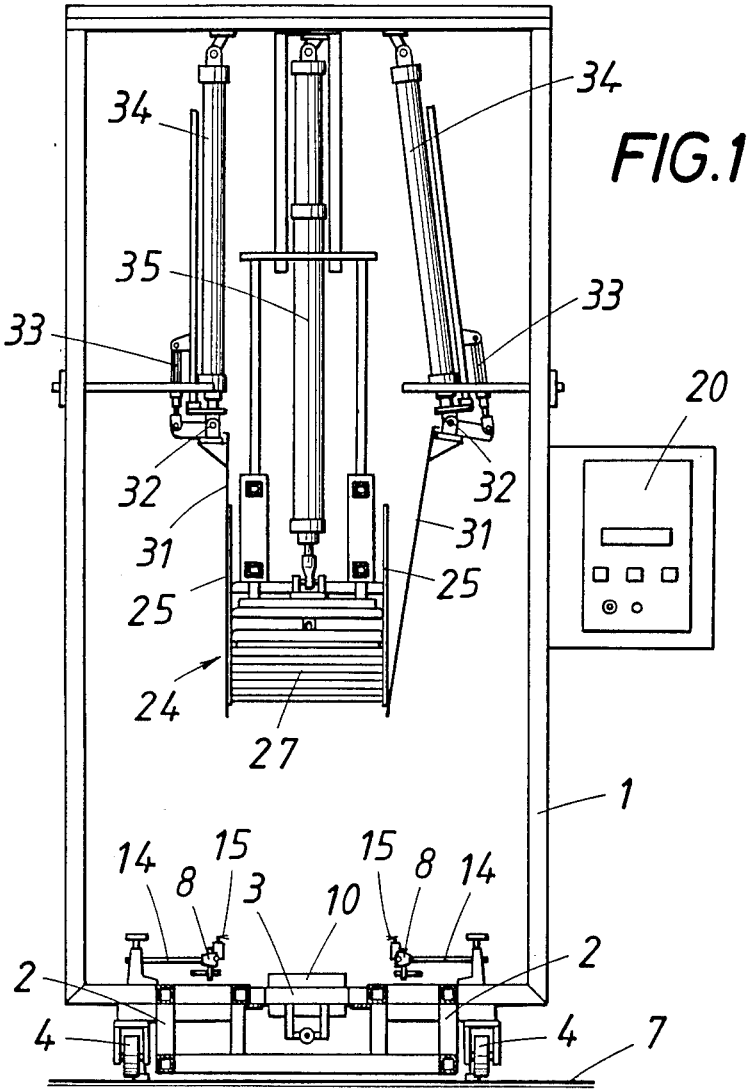
FIG. 1 is a diagrammatic elevation showing an apparatus in accordance with the invention for carrying out the process in accordance with the invention.
Figure 4:
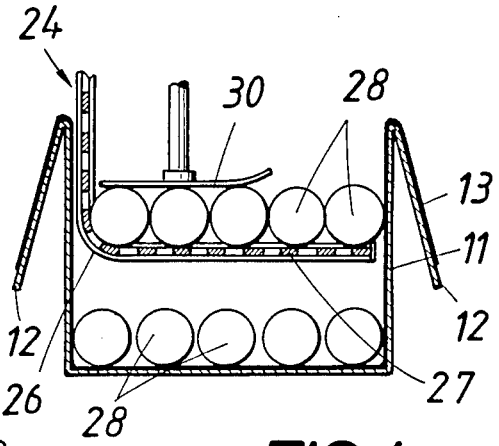
FIG. 4 is a diagrammatic view showing a container that is disposed in the filling station with a part of the inserted layer-forming means shown in section.

In its operative position the apparatus is supported on the floor 7 and is optionally leveled by means of supports 6 which are adapted to be screwed out. The working deck 3 constitutes a conveyor track, which is provided on the left and right with guide rails 8. A pneumatic or hydraulic actuating piston 9 drives pushers 10, which are extensible above the working deck 3. The deck 3 is part of a filling station, which receives consecutive packaging cartons on the right in FIG. 2. In accordance with FIG. 4 said packaging cartons 11 may have infoldable closing flaps 12 and may be provided with an infoldable lining wrapper 13. The piston actuator 9 and the coupling member 10 constitute an intermittent conveyor, by which a carton which has been placed onto the deck 3 on the right in FIG. 2 can be pushed to a packaging position within the mainframe 1. Adjustable stops 14 are provided to permit an adaptation to the size of a given carton. In accordance with FIG. 1, no mechanical stops are provided but light barriers 15 are used to control by means of a controller the positioning of a carton in its receiving position within the mainframe. The positioning may be effected by means of the intermittent conveyor 9, 10 or by means of separate additional positioning means (not shown). When a carton has been filled, an empty carton previously placed on the deck on the right is pushed in and the filled carton leaves the deck 3 toward the left in FIG. 2. Alternatively the deck 3 may adjoin a carton feeder for additonal cartons and/or may be connected to a receiving conveyor for filled cartons which have been pushed out to the left. Closing means, not shown, may be provided above the left-hand region of the deck 3 and may serve to close the sack-like wrapper 13, and optionally to evacuate and seal it, and to infold the closing flaps 12 of the carton 11 and to fix them in the infolded position by adhesive tapes, binding means etc..

The above-mentioned trough 5 is a constituent part of a feeder, which is provided at its inlet with mutually opposite brushlike means 16, which during the passage of a cup rim between them yield resiliently or retain a cup at its rim as the cup is received so that a predetermined resistance will be presented as the cups are pushed together by the ejector of the manufacturing machine. The brushes 16 may be coupled to counting means which respond to every resilient yielding so that the number of resilient yielding movements will correspond to the number of cups which have passed. The brushes 16 are adjustable and can be adjusted to suit existing conditions. A fixed stop 18 and an adjustable stop 19 are mounted on a rod 17, and permit the formation of stacks of cups in a predetermined length. The number of cups in a stack can be detected by the counting means and indicated to a central controller 20. Pulling-off means, e.g., means provided with air nozzles, may be used to divide the string of stacked cups into the individual stacks mentioned above. When a stack has reached a position that is defined by light barriers 21, the controller 20 starts a transverse conveyor 22, which by means of a transversely extending pusher 23 pushes the stack which has been positioned into layer-forming means 24. Said layer-forming means 24 comprise side walls 25, which constitute guides for a flexible bottom 27, which like a rolling shutter is guided around a corner deflector 26. The layer-forming means 24 are open on the side which faces the trough 5. The layer-forming means can be lifted to the position shown in FIG. 2 and can be lowered in steps to different lower positions by a controlled piston actuator 35, which is held at the top of the mainframe. In its lowermost position the layer-forming means 24 rest on the bottom of a carton 11 disposed in the filling station and in subsequent lowering operations are adjusted by the controller 20 to stop in a position which is higher than the previous position by the height of one layer. In the position shown in FIG. 2 the transverse conveyor 22, 23 is used to push successive individual stacks 28 into the layer-forming means 24. When a layer has been filled —this may be indicated in that the strokes of the transverse conveyor 22, 23 are counted in the controller 20 —the piston actuator 35 is operated to lower the layer-forming means until they extend into the carton 11 as far as to the bottom or to the previously deposited layer. By means of a piston actuator 29 the flexible bottom 27 is deflected around a corner and pulled upwardly so that the layer previously contained in the layer-forming means is deposited in the carton in an orderly arrangement. An optionally adjustable holding-down member 30 provided in the layer-forming means will prevent a rising of individual stacks within the layer as the bottom 27 is pulled off.

The depths to which the layer-forming means are lowered can be adjusted if feelers for defining different positions are provided on the piston actuator 35. Said feelers may consist, e.g., of spaced apart reed relays or, in a different embodiment, of lengths measuring means which cooperate with light barriers. By means of the controller 20 said feelers will determine the depth to which the layer-forming means are extended. The controller 20 may be programmable for an adaptation to different cartons and stack sizes.

In order to permit a satisfactory packaging when the wrappers 13 are only loosely inserted into the cartons, an inserting aid is provided for assisting the insertion and retraction of the layer-forming means 24. The insertion aid consists of winglike wall elements (31), which fit the end walls of the carton 11 and are pivoted on pivots 32 by means of cylinder-piston units 33. The pivots 32 are provided on head pieces of cylinders-piston units 34, which are slidably and pivotally mounted on the frame 1. By a controlled actuation of the cylinder-piston units 33, 34 the wall elements 31 can be independently lowered into the carton 11 in the filling station and can be pivotally moved. The control is effected in such a manner that the wall elements 31 are lowered in an inclined position (shown on the right in Figur 1) and are moved toward each other as soon as they have moved past the raised layer-forming means 24. In that case their lower edges face in an inclined direction the carton bottom in a region which is spaced from the associated end wall. As soon as they engage the bottom of the carton or are close to said bottom, the wall elements 31 are turned outwardly to a straight position in which they essentially contact the associated end walls of the carton 11. During their movement to that straight position the wall elements wipe on and smoothen the wrapper 13 on the bottom of the carton. Thereafter the carton is filled by means of the layer-forming means 24 with the layers consisting of the stacks 28 in the manner which has been described. When the carton 11 has been filled, the wall elements 31 are pulled out. Alternatively they might be pulled out in steps corresponding to the height of one layer whenever a layer consisting of the stacks 28 has been formed.

It has been mentioned that the operation of the entire apparatus is controlled by the controller 20, which is connected to the stops, light barriers 15, 23, sensors for measuring the elevation of the layer-forming means, the counters controlled by the counting means 16, the means for separating the individual stacks and the various piston actuators and as a programmed controller controls the actuation of the several piston actuators. For various packaging operations to be performed by the same machine and involving, e.g., changes of the size and number of the stacks and changes of the carton sizes, the necessary control commands may be prestored and in case of need may be called for delivery to the controller.

It will be understood that it is not essential to provide the apparatus itself with means for forming individual stacks. Alternatively, the manufacturing machine may be used to make stacks consisting of a predetermined number of objects and said stacks may be fed. In that case the brushes 16 will constitute restraining means for effecting a uniform compression of the elements within the stack.

We claim:

1. A process of packaging stacks consisting of nested cuplike objects having a basic shape of elongate cylinders, wherein the stacks are inserted into containers to form a plurality of layers each consisting of a plurality of stacks in a horizontal orientation, comprising the steps of (a) feeding respective ones of the stacks longitudinally of the axis thereof to respective ones of the containers in a horizontal orientation, (b) then feeding the respective stack transversely of said axis to a layer-forming means having a flexible bottom and arranged over the respective container until the layer-forming means contains a complete layer of stacks supported on the flexible bottom, (c) lowering the layer-forming means and the layer of stacks contained therein into the respective container, (d) then deflecting the flexible bottom of the layer-forming means and pulling the deflected flexible bottom out from under the layer and upwardly beside the layer whereby the layer is deposited in the respective container while maintaining the orientation of the stacks in the layer, (e) thereafter raising the layer-forming means into a region in which the stacks are fed, (f) returning the flexible bottom to a position wherein it closes the layer-forming means, and (g) repeating steps (a) to (f).

2. The process of claim 1, wherein the said stacks are fed in the form of an endless rod of nested cuplike objects, comprising the further steps of counting the objects as the stacks are fed, and pulling each of said stacks from the endless rod when an intended number of objects for each of said stacks has been counted.

3. The process of claim 1, wherein the container is a parallelepipedic container having a bottom wall and side walls, further comprising the steps of inserting a flexible sack-like wrapper by plate-like elements into the container from above in front of the ends of the stack, holding said wrapper throughout the feeding operation in the form of an open-topped liner in contact with the container walls and protruding above the side walls, pulling the plate-like elements upwardly out of the container when a last one of the layers of stacks has been fed into the container, evacuating the wrapper while it is still lining the container walls, and air-tightly closing the wrapper to form a package removable from the container and maintaining the stacks therein in position, the external shape of the package being determined by the shape of the container.

4. Apparatus for packaging stacks, which consist of cuplike objects and have the basic shape of elongate cylinders, into containers which accommodate said stacks in a plurality of layers consisting each of a plurality of stacks, comprising a filling station for supporting the containers, which by means of a conveyor are movable into and out of the filling station, a feeder for feeding stacks in a horizontal attitude in their longitudinal direction into a region that is disposed above the top edge of the containers, layer-forming means, which are disposed above the filling station and accommodate a layer formed by a plurality of juxtaposed stacks, a transverse conveyor, which is associated with the feeder, and means for adjusting the layer-forming means so that the layer-forming means and a layer formed by the stacks can be lowered into the container to a preselectable depth, wherein the layer-forming means comprise a flexible bottom, which from a position in which the bottom closes the layer-forming means in the container can be deflected and pulled out toward one side and upwardly to expose a bottom opening of the layer-forming means, and control means are provided, which control the means for driving the transverse conveyor, the means for lifting and lowering the layer-forming means, and the inward and outward movements of the bottom of the layer-forming means, so that each stack of cups arriving in front of the layer-forming means is pushed by the transverse conveyor transversely to the longitudinal direction of the stack into the layer-forming means, which are in their receiving position, and when an orderly layer of stacks has been formed the layer-forming means are lowered into the container, the flexible bottom is removed so that the layer is deposited in the container while the mutual association of the stacks in the layer is maintained, the layer-forming means are returned to their receiving position, the bottom is closed, the layer-forming means are made ready to form a new layer, and each filled container in the receiving station is replaced by a new one.

5. Apparatus according to claim 4, wherein the removable bottom of the layer-forming means is similar to a rolling shutter and by means of guides and a corner deflector is adjustable from its operating position, in which it assists the layer, to a releasing position in which the bottom is disposed laterally beside the space for receiving the layers, and a holding-down member for the layion in which the bottom is disposed laterally beside the space for receiving the layers, and a holding-down member for the layer of stacks which has been formed is disposed over the bottom.

6. Apparatus according to claim 4, wherein the layer-forming means are adapted to be lowered in steps to different elevations by means of the controller and the drive means and the height of each step equals the height of the layer.

7. Apparatus according to claim 4, wherein the feeder constitutes a longitudinal feeder, which is provided in front of the working range of the transverse conveyor with counting means for counting the individual cuplike objects of the stack being fed, which counting means are connected to the controller, and separating means for dividing an endless string of cuplike articles into a stacks containing a predetermined number of said objects.

8. Apparatus according to claim 4, wherein an inserting aid for a sacklike flexible lining of the container is provided and holds said liner so that it is open-topped and contacts the side walls and the bottom of the layer-forming means as the latter are inserted and removed, said inserting aid comprises platelike elements, which are associated with the ends of the container and by separate drive means are adapted to be inserted from above before the layerforming means into the container disposed in the receiving station, and said platelike elements are adapted to be inserted by the drive means at a distance from the walls to a position adjacent to the bottom of the container and are subsequently adjustable as far as to the associated side walls of the container and in the resulting position can be pulled out when the container has been filled.

9. Apparatus according to claim 4, wherein the filling station, the stack-forming means and the separating means are adjustable to different lengths and stack diameters and to containers having different sizes and the control means adjustable to different control programs.

* * * * *